US008371022B2

(12) United States Patent
Rye et al.

(10) Patent No.: US 8,371,022 B2
(45) Date of Patent: Feb. 12, 2013

(54) METHOD FOR ASSEMBLING A PORTABLE DEVICE CONFIGURED WITH AN ENERGY STORAGE DEVICE

(75) Inventors: Ryan P Rye, Duluth, GA (US); William S Doolan, Atlanta, GA (US)

(73) Assignee: Motorola Mobility LLC, Libertyville, IL (US)

( * ) Notice: Subject to any disclaimer, the term of this patent is extended or adjusted under 35 U.S.C. 154(b) by 1113 days.

(21) Appl. No.: 12/323,515

(22) Filed: Nov. 26, 2008

(65) Prior Publication Data

US 2010/0126833 A1 May 27, 2010

(51) Int. Cl.
*H01H 17/16* (2006.01)

(52) U.S. Cl. ..... 29/622; 29/825; 29/830; 29/831; 429/90

(58) Field of Classification Search ..... 29/622, 29/830, 831, 832, 852; 446/298, 456; 429/7, 429/49, 50, 101; 235/385, 492, 439, 440, 235/375

See application file for complete search history.

(56) References Cited

U.S. PATENT DOCUMENTS

| | | | | |
|---|---|---|---|---|
| 4,551,028 | A | 11/1985 | Rowen et al. | |
| 6,138,010 | A * | 10/2000 | Rabe et al. | 455/426.1 |
| 6,270,916 | B1 * | 8/2001 | Sink et al. | 429/7 |
| 6,371,829 | B1 * | 4/2002 | Kato et al. | 446/456 |
| 6,389,143 | B1 * | 5/2002 | Leedom et al. | 381/323 |
| 6,426,863 | B1 * | 7/2002 | Munshi | 361/503 |
| 6,821,183 | B2 | 11/2004 | Blackman et al. | |
| 6,837,739 | B2 | 1/2005 | Gorringe et al. | |
| 7,059,769 | B1 * | 6/2006 | Potega | 374/185 |
| 2008/0194175 | A1 * | 8/2008 | Last et al. | 446/302 |
| 2009/0088194 | A1 * | 4/2009 | Petty et al. | 455/502 |
| 2009/0163111 | A1 * | 6/2009 | Garbos et al. | 446/298 |

* cited by examiner

*Primary Examiner* — Derris Banks
*Assistant Examiner* — Kaying Kue
(74) *Attorney, Agent, or Firm* — Gary J. Cunningham

(57) ABSTRACT

A method (100) for assembling a portable device configured with an energy storage device, is disclosed. The method (100) can include: providing (105) a portable device with a controller configured to control the operations of the portable device; configuring (110) the portable device with a multi-mode switch including a temporary active mode configured for simplified testing, a temporarily inactive mode configured for minimizing power drain, and a permanent active mode for normal user operation; and controlling (115) the multi-mode switch from outside the portable device. The method (100) can help to prolong the useful shelf life of the device and can help to simplify testing and calibrating before shipping.

16 Claims, 8 Drawing Sheets

METHOD FOR ASSEMBLING A PORTABLE DEVICE CONFIGURED WITH AN ENERGY STORAGE DEVICE

BACKGROUND

1. Field

The present disclosure is directed to a method for assembling a portable device configured with an energy storage device.

2. Introduction

Currently on most electronic products and accessories with embedded batteries, there is a parasitic load applied by the device circuitry. This is a very small current that the circuitry consumes while the product's on-off switch is in the "off" mode. To minimize the risk of an energy storage device such as a battery being "unchargeable" or causing a "dead" product, after a certain period of time (such as a few hundred days), the parasitic load needs to be removed.

The idea of using a "thin material to prevent a battery connection until the product is first used by a consumer" is not new. Typically this is done by placing part of a removable label between a battery and a spring terminal inside a product. This is often done in smoke detectors.

What is needed is a method to assemble a portable device with an energy storage device that provides a multi-mode switch that provides a temporarily closed position for testing and temporarily open for shipping, based on a position of a pull tab, and a permanently closed position when the pull tab is removed. In more detail, the pull tab needs to extend outside the product's housing, so that a user can pull the tab completely out to close the switch when the product is first used. What is needed is a via in the pull tab to allow a manufacturer or assembler to test completed or sealed units in the factory before shipping. Next. the manufacturer can adjust the pull tab forward to "open" the switch circuit prior to shipping to the customer. The open position prevents battery connection until the product is first used by the consumer.

What is needed is a method of assembling a portable device with energy storage device that allows for testing, calibrating and loading for example before shipment to a customer and minimizes the possibility of embedded-battery products reaching consumers in an "unchargeable" or "permanently dead" state, if left on a shelf or in a warehouse for a certain amount of time.

Thus, there is a need for a method for prolonging the useful shelf life of an energy storage device in a portable device.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
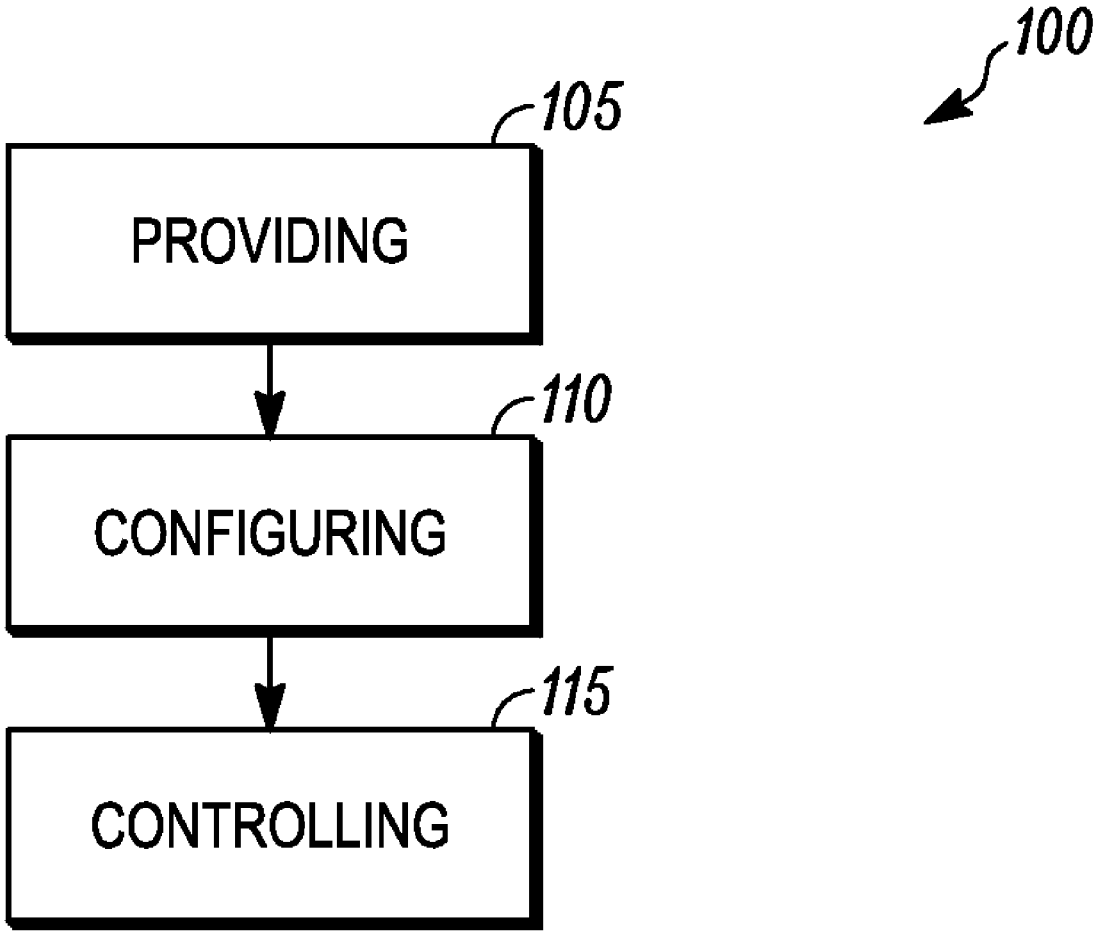
FIG. 1 is an exemplary block diagram of a method for assembling a portable device configured with an energy storage device, according to one embodiment.

Referring to FIG. 1, a simplified block diagram of a method 100 for assembling a portable device configured with an energy storage device, is shown. In its simplest form, the method 100 can include: providing 105 a portable device with a controller configured to control the operations of the portable device; configuring 110 the portable device with a multi-mode switch including a temporary active mode configured for simplified testing, a temporarily inactive mode configured for minimizing power drain, and a permanent active mode for normal user operation; and controlling 115 the multi-mode switch from outside the portable device. Advantageously, the method 100 can help to prolong shelf life of the device and can help to simplify testing and calibrating before shipping, as detailed below.

Figure 2:
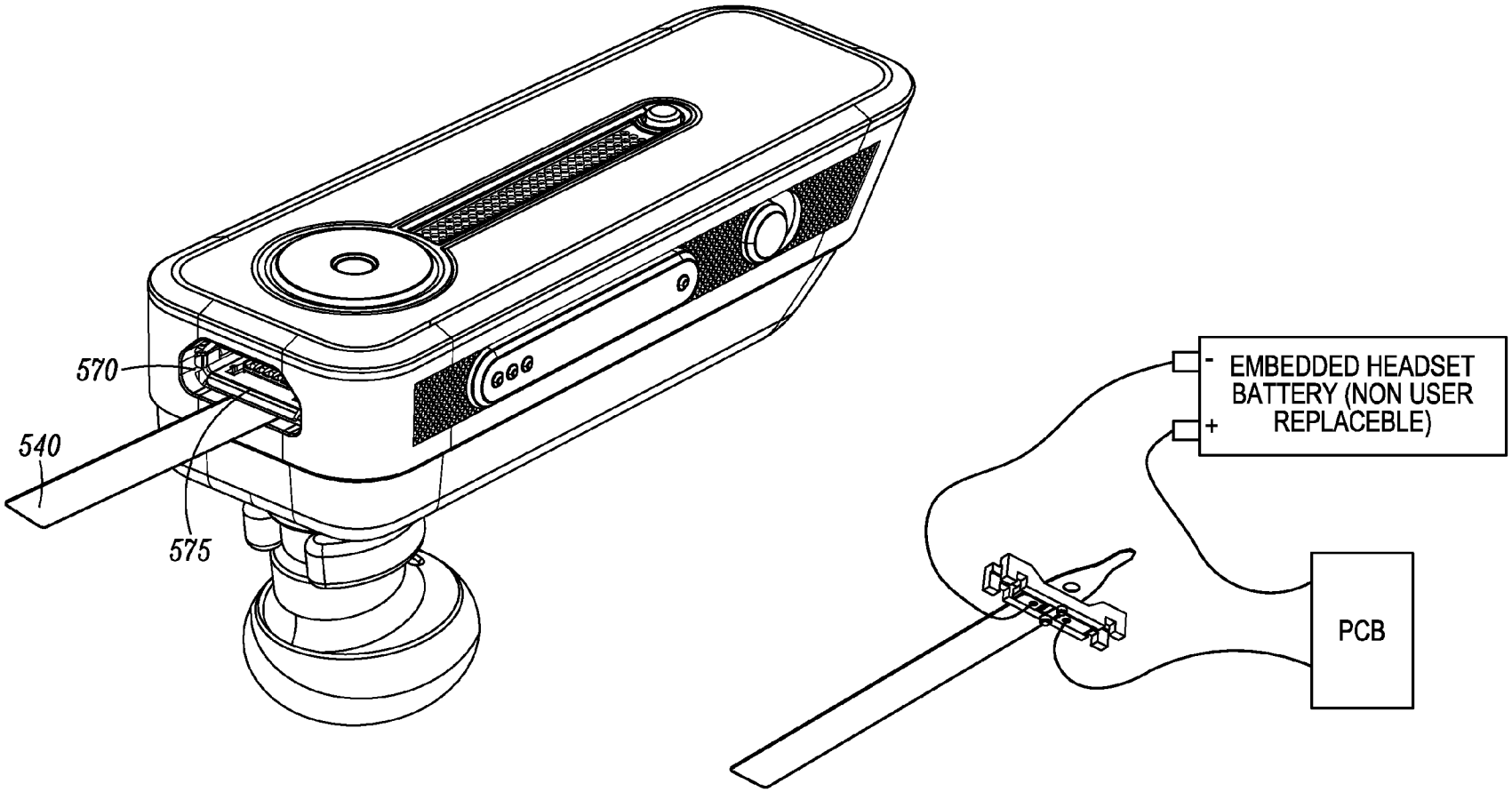
FIG. 2 is a perspective view of a portable device in the form of a sealed headset with an embedded energy storage device on the left and some of the contents therein shown on the right including a multi-mode switch, battery and print circuit board, according to one embodiment.
Figure 3:
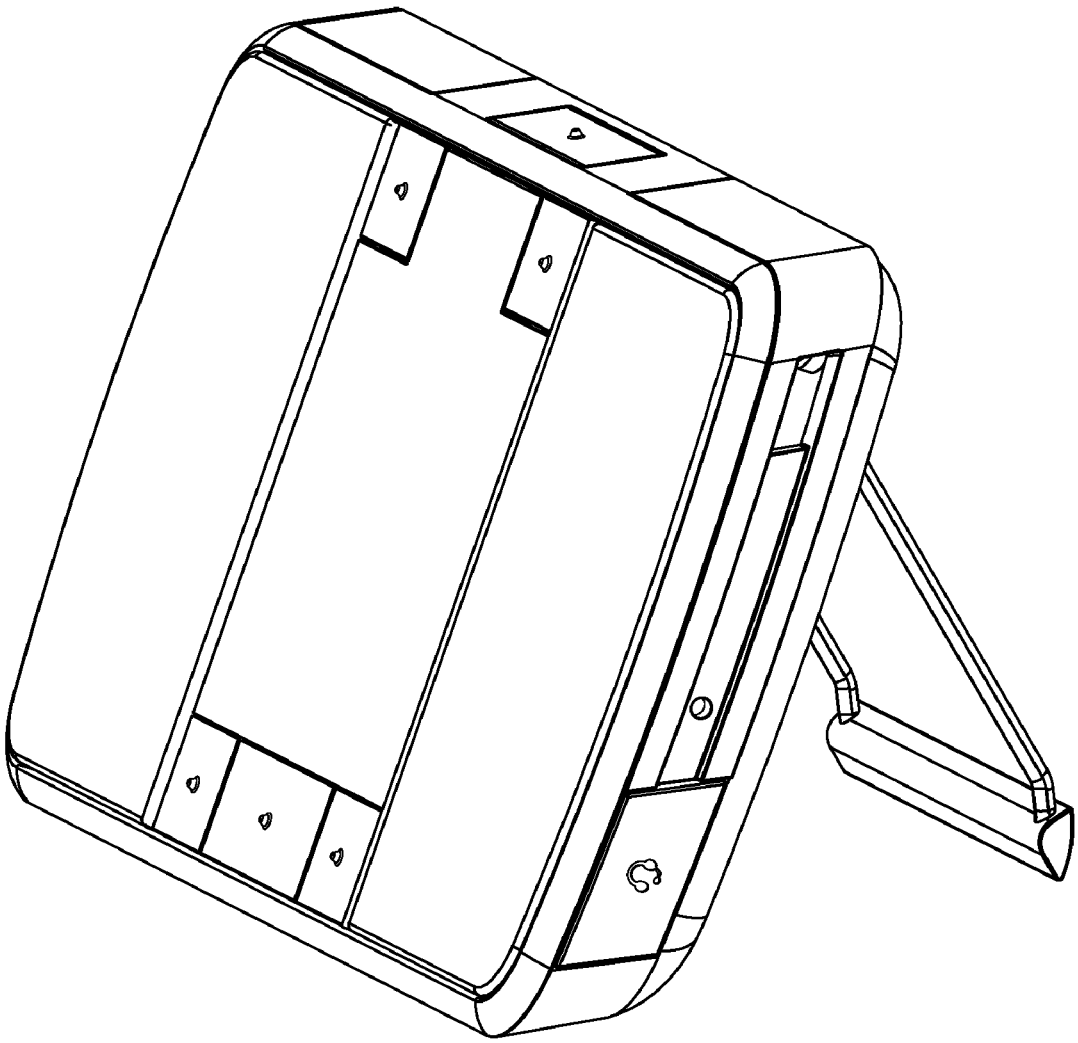
FIG. 3 is a perspective view of a portable device in the form of a Bluetooth speaker system with an embedded energy storage device, according to one embodiment.
Figure 4:
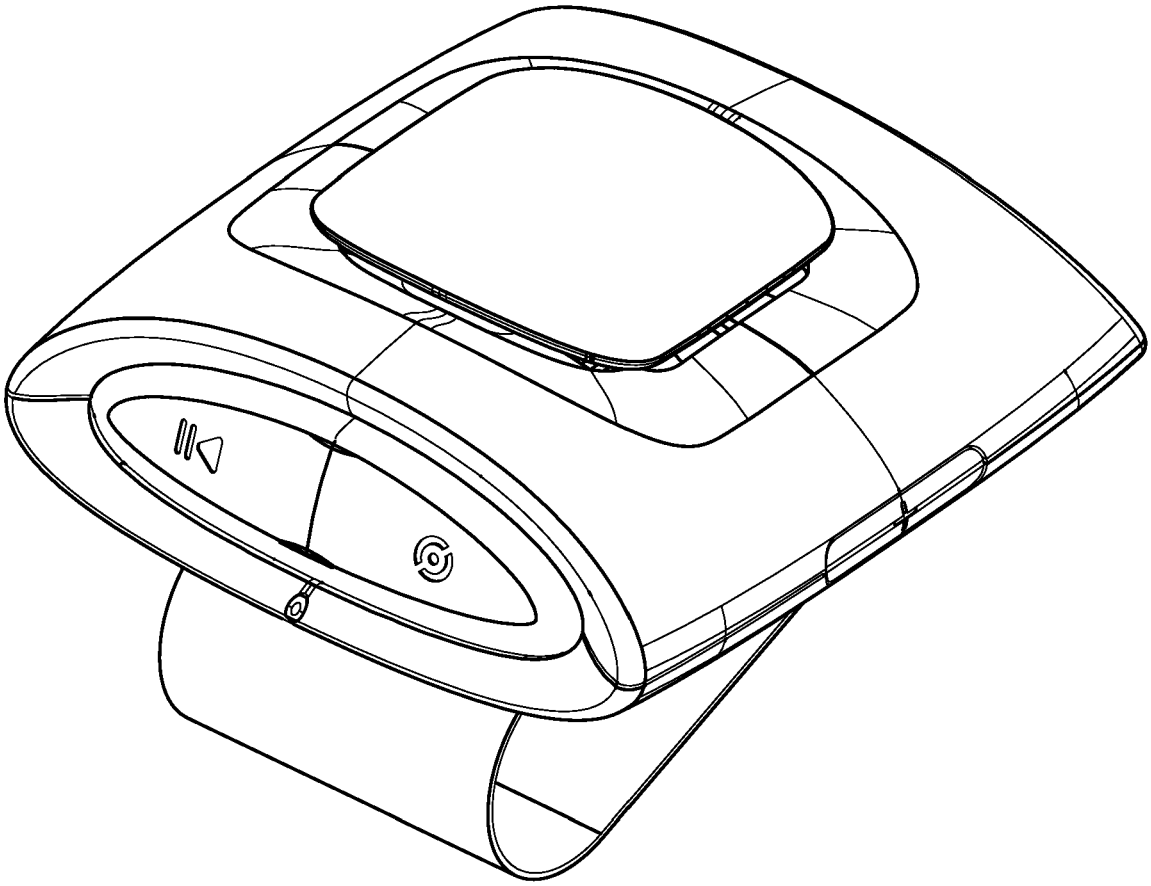
FIG. 4 is a perspective view of a portable device in the form of a Bluetooth hands free car kit with an embedded energy storage device, according to one embodiment.

In more detail, the portable device can be a wireless communication device adapted for use in a network, such as personal area network. For example, the device can be a Bluetooth headset or visor clip on, which is wirelessly connected to a cell phone via a personal area network, such as a Bluetooth connection. In this type of application, a user can operate a headset, speaker system or car kit, as shown in FIGS. 2-4, substantially hands free, for improved sound quality and minimal distractions, such as when working out, driving an automobile, multi-tasking and the like.

As illustrated in FIGS. 5-8, the configuring step 110 is shown in more detail. In a preferred embodiment, the configuring step 110 can include: constructing a multi-mode switch 500 with a nonconductive base 505, a conductive top contact 510 and conductive bottom contact 515 substantially aligned, shown in phantom by item 520, such that a portion of the conductive top 525 and a portion of the bottom contact 530 are biased toward each other, shown in phantom by item 535, to be in contact and a pull tab 540 with a via 545; and adjusting a pull tab 540 to be in a first position 550 corresponding to the temporary active mode, a second position 555 corresponding to the temporary inactive mode and a removed position 560 corresponding to the permanent active mode for normal user operation.

In more detail, when the pull tab 540 is in the first position 550 corresponding to the temporary active mode in the adjusting step, the method 100 can further include: aligning the via 545 with a portion of the top and the bottom conductive contacts 525 and 530, respectively; and allowing current to flow between the top and the bottom conductive contacts 510 and 515 through the via 545, defining a temporary closed switch position.

Figure 5:
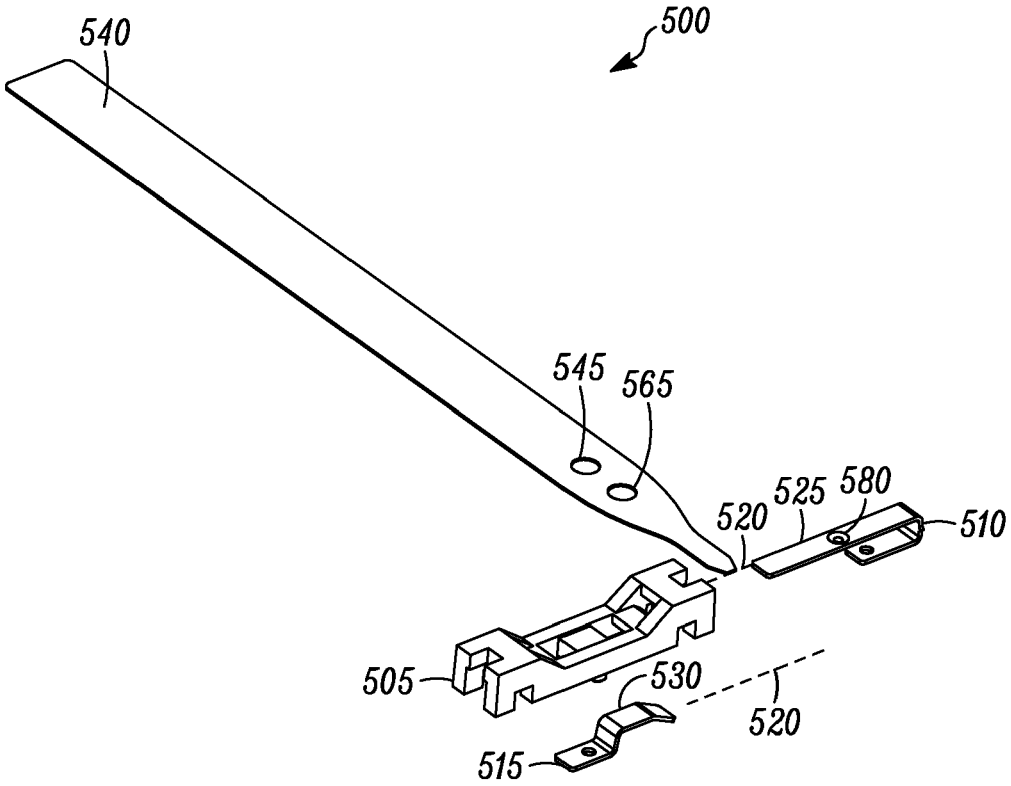
FIG. 5 is a partial exploded view of a multi-mode switch used in connection with the method for assembling a portable device configured with an energy storage device in FIG. 1, according to one embodiment.

In yet more detail, in a preferred embodiment, a substantially downwardly pointing indent 580 is shown in FIG. 5 and the other figures. The indent 580 is located at a generally middle portion of the top contact 525, to provide a lock and registration for the contact 510 and via 545, such that the pull tab will not slide or exit, when in a temporary closed position. The indent 580 also provides an electrical connection and contact point between the top and bottom contacts 510 and 515, for a secure closed switch connection, when the pull tab is in a temporary closed position.

In still more detail, the multi-mode switch 500 can be constructed to include: providing the pull tab 540 with two vias 545 and 565, configured to allow at least two temporary active modes; aligning at least one of the vias 545 or 565 with a portion of the top and the bottom conductive contacts 525 and 530; and allowing current to flow between the top and the bottom conductive contacts 510 and 515 through the aligned at least one via 545, defining a temporary closed switch position.

Figure 8:
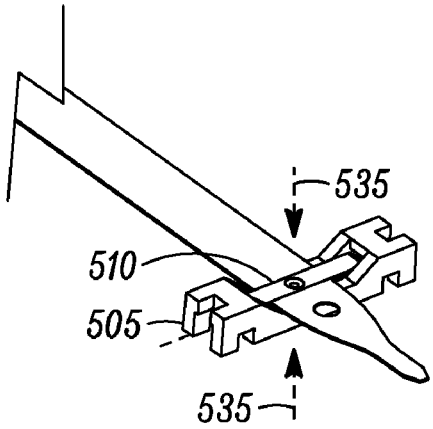
FIG. 8 is a partial perspective view of a third assembly step of a multi-mode switch used in connection with the method for assembling a portable device configured with an energy storage device in FIG. 5, according to one embodiment.

When in the temporary closed switch position, as illustrated in FIGS. 2 and 8, the portable device, such as those shown in FIGS. 2, 3 and 4, can be tested, for example, relative to at least one of acoustics, audio quality of the internal speakers, calibration of multiple internal microphones, confirmation of proper multi-function button operation, volume operation, power switch operation, and/or noise cancellation algorithm operation. A USB port can be used for testing (measuring outputs from the assembled device), for example. The pull tab 540 can be adjusted by pulling the pull tab 540 from and away from an opening 570, such as a USB opening of a portable device, as shown in FIG. 2.

Figure 10:
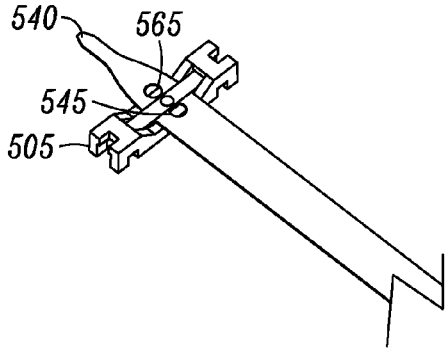
FIG. 10 is a partial perspective view of the multi-mode switch shown in a second temporary open position, according to one embodiment.

When the pull tab is in the second position 555 corresponding to the temporary inactive mode, relative to the adjusting step, the via 545 is misaligned (not in alignment) with a portion of the top and the bottom conductive contacts 525 and 530, as shown in FIG. 10; and current is prohibited from flowing between the top and the bottom conductive contacts 510 and 515 through the via 545 due to the misalignment, defining a temporary open switch position. In more detail, the pull tab 540 insulates the top and the bottom conductive contacts 510 and 515, providing the open switch position, as shown in FIG. 10. In more detail, registration markings on the pull tab 540, such as evenly spaced lines with numbers, can serve as a visual guide to help a manufacturing line operator pull the tab the required amount, such that the pull tab 540 is placed in the desired position, thus minimizing the possibility of pulling the pull tab 540 to far and activating the next "closed switch" position, for example.

Figure 6:
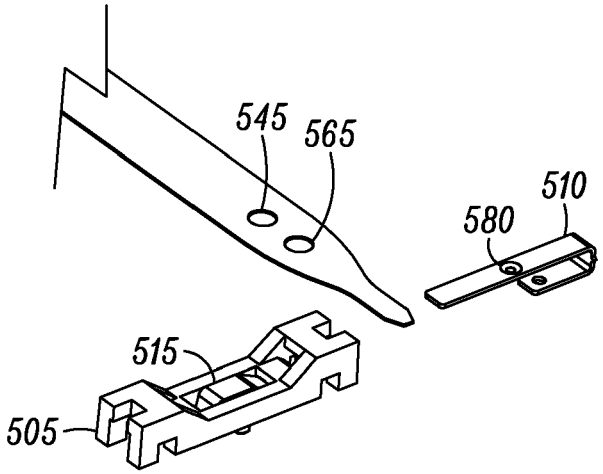
FIG. 6 is a partial exploded view of a first assembly step of a multi-mode switch used in connection with the method for assembling a portable device configured with an energy storage device in FIG. 5, according to one embodiment.
Figure 7:
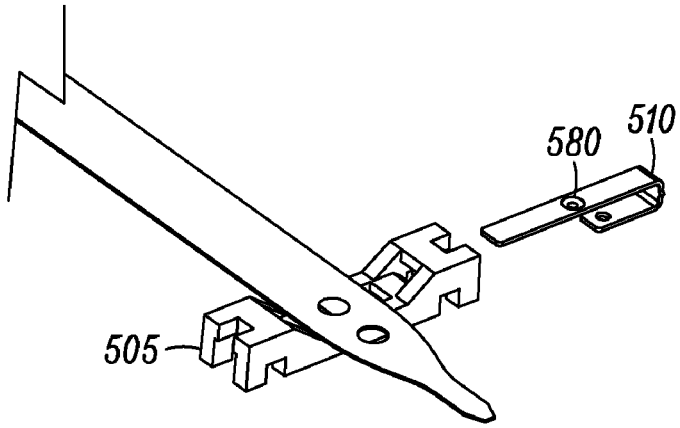
FIG. 7 is a partial exploded view of a second assembly step of a multi-mode switch used in connection with the method for assembling a portable device configured with an energy storage device in FIG. 5, according to one embodiment.

Shown in FIG. 6 is a partial perspective view of a first assembly step of the multi-mode switch. The bottom contact 515 is shown being inserted into a complementarily configured portion of the base 505. The second assembly step shown in FIG. 7 shows the pull tab 540 being placed over a center portion 530 of the bottom contact 515. The via 545 is aligned with a portion of the bottom contact 530. In FIG. 8, the top contact 510 is shown inserted into a complementarily configured portion of the base 505. The base 505 is configured to bias, as shown in phantom as 535, the top contact 510 down and the bottom contact 515 up, to provide a good electrical contact and to maintain the pull tab in a desired position.

Figure 9:
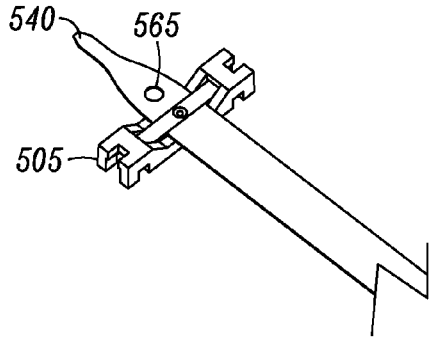
FIG. 9 is a partial perspective view of the multi-mode switch shown in a first temporary closed position, according to one embodiment.

The multi-mode switch 500 in FIG. 9 is shown in a first "temporary closed" position, for testing for example, and in FIG. 10, is shown in a second "temporary open" position. Here the battery is disconnected for minimal loss of charge. A portable device can sit on a shelf in this state.

Figure 11:
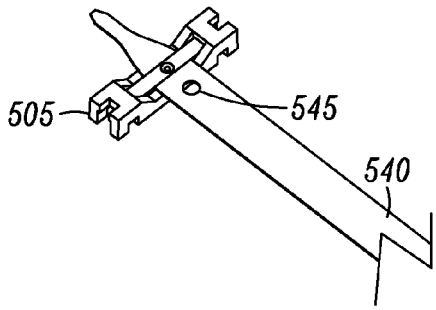
FIG. 11 is a partial perspective view of the multi-mode switch shown in a second temporary closed position using a second via, where for example, additional testing, an additional audit, inspection, software upgrade or patch, etc. can be done at a distribution center avoiding scraping the products, according to one embodiment.

In the event that additional tests, audits, inspections, software upgrade or patch, etc. are required at a distribution center, a second via 565, as shown in FIG. 11, can be used to provide a second "temporary closed" position, in one embodiment. This arrangement can help to avoid scrapping of products needing upgrade or additional tests, for example.

Figure 12:
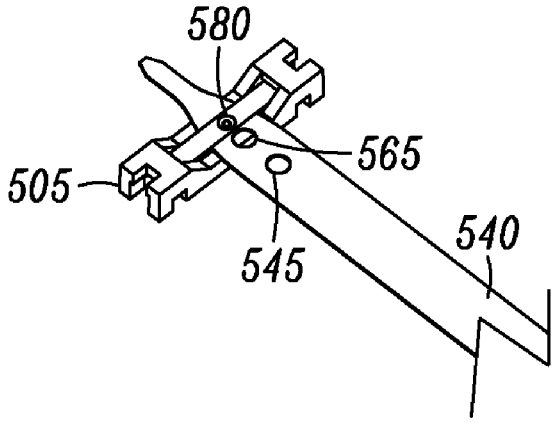
FIG. 12 is a partial perspective view of the multi-mode switch shown in a second temporary open position, after additional testing has been completed at a distribution center in FIG. 11, for example, according to one embodiment.

Once completed, the pull tab is pulled, as shown in FIG. 12, to a second "temporary open" position, after additional testing has been completed at a distribution center and the product re-packaged, for example.

Figure 13:
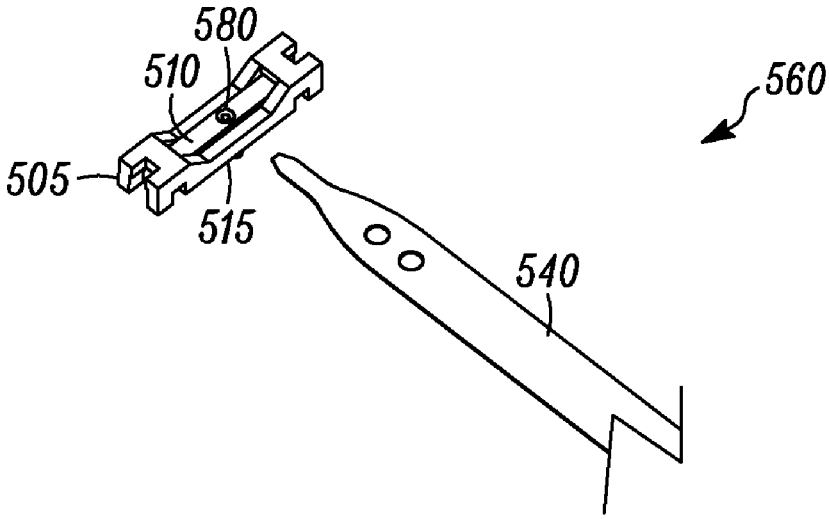
FIG. 13 is a partial perspective view of the multi-mode switch shown with the pull tab removed, in a permanent closed position, according to one embodiment.

As shown in FIG. 13, the pull tab 540 is shown in a removed position 560. In operation, the pull tab 540 is removed corresponding to the permanent active mode for normal user operation, thus allowing current to directly flow between the top and the bottom conductive contacts 510 and 515, defining a permanently closed switch position.

In a preferred embodiment, the portable device is configured to operate in a substantially hands free environment. For example, the portable device is a wireless communication device with memory and a transceiver for use in a personal area network, and is particularly adapted for use in a head set, speaker system or car kit, as shown in the figures. Further, the portable device includes a substantially sealed housing to a user, with a substantially permanently embedded energy storage device, for minimizing size, weight, cost, and foot print, for many applications.

The energy storage device can include at least one of a battery, a fuel cell, a fuel container and an electrochemical capacitor. In a preferred embodiment, the energy storage device includes a lithium ion battery.

Advantageously, the wireless communication device 200 can provides a simple, portable, compact and robust power savings feature that can actuate a display when properly orientated for viewing by a user, and not actuate the display when not suitably oriented.

Advantageously, this can provide a user with a number of options when suitably oriented.

In one arrangement, the providing step 402 can include providing the wearable device in a personal area network headset, such as a Bluetooth headset, which step can be particularly useful in two radio and mobile phone applications, for example. While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure. In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method for assembling a portable device configured with an energy storage device, comprising:

providing a portable device with a controller configured to control the operations of the portable device, the portable device being a wireless communication device adapted for use in a network;

configuring the portable device with a multi-mode switch including a temporary active mode configured for simplified testing, a temporarily inactive mode configured for minimizing power drain, and a permanent active mode for normal user operation;

providing an energy storage device including at least one of a battery, a fuel cell, a fuel container and an electrochemical capacitor;

controlling the multi-mode switch from outside the portable device;

constructing the multi-mode switch with a nonconductive base, a conductive top contact and conductive bottom contact substantially aligned such that a portion of the conductive top and the conductive bottom contacts are biased to be in contact and a pull tab with a via; and adjusting the pull tab to be in a first position corresponding to the temporary active mode, a second position corresponding to the temporary inactive mode and a removed position corresponding to the permanent active mode for normal user operation, wherein when the pull tab is in the first position corresponding to the temporary active mode, the via is aligned with a portion of the top and the bottom conductive contacts to allow current to flow between the top and the bottom conductive contacts through the via, defining a temporary closed switch position, and wherein when the pull tab is in the second position corresponding to the temporary inactive mode, the via is misaligned with a portion of the top and the bottom conductive contacts and current is prohibited from flowing between the top and the bottom conductive contacts through the via due to the misalignment, defining a temporary open switch position.

2. The method of claim 1, wherein when the pull tab is in the first position corresponding to the temporary active mode in the adjusting step, further including: aligning the via with a portion of the top and the bottom conductive contacts; and allowing current to flow between the top and the bottom conductive contacts through the via, defining a temporary closed switch position.

3. The method of claim 1, wherein the constructing step includes: providing the pull tab with at least two vias configured to allow at least two temporary active modes; aligning at least one of the vias with a portion of the top and the bottom conductive contacts; and allowing current to flow between the top and the bottom conductive contacts through the aligned at least one via, defining a temporary closed switch position.

4. The method of claim 1, wherein when the pull tab is in the first position corresponding to the temporary active mode in the adjusting step, further including: allowing current to flow between the top and the bottom conductive contacts through the via, defining a temporary closed switch position; and testing the portable device relative to at least one of acoustics, audio quality for internal speakers, calibration of multiple internal microphones, confirmation of proper multi-function button operation, volume operation, power switch operation, and noise cancellation algorithm operation.

5. The method of claim 1, wherein when the pull tab is in the second position corresponding to the temporary inactive mode in the adjusting step, further including: misaligning the via with a portion of the top and the bottom conductive contacts; and prohibiting current to flow between the top and the bottom conductive contacts through the via due to the misalignment, defining a temporary open switch position.

6. The method of claim 1, wherein the adjusting step further includes removing the pull tab through an opening in the portable device corresponding to the permanent active mode for normal user operation allowing current to directly flow between the top and the bottom conductive contacts, defining a permanently closed switch position.

7. The method of claim 1, wherein the configuring step includes operating the portable device in a substantially hands free environment.

8. The method of claim 1, wherein the providing step includes constructing the portable device in a substantially sealed housing to a user with a substantially permanently embedded energy storage device.

9. The wireless communication method of claim 1, wherein the providing step includes providing memory and a transceiver coupled to the controller.

10. A method for assembling a portable device configured with an energy storage device, comprising:

providing a portable device with a controller configured to control the operations of the portable accessory;

configuring the portable device with a multi-mode switch including a temporary active mode configured for simplified testing, a temporarily inactive mode configured for minimizing power drain, and permanent active mode for normal user operation, by:

constructing the multi-mode switch with a nonconductive base, conductive top and bottom contacts aligned such that a portion of the conductive top and bottom contacts are biased to be in contact and a pull tab with a via; and adjusting the pull tab to be in a first position corresponding to the temporary active mode, a second position corresponding to the temporary inactive mode and a removed position corresponding to the permanent active mode for normal user operation; and controlling the multi-mode switch from outside the portable device, wherein when the pull tab is in the first position corresponding to the temporary active mode, the via is aligned with a portion of the top and the bottom conductive contacts to allow current to flow between the top and the bottom conductive contacts through the via, defining a temporary closed switch position, and wherein when the pull tab is in the second position corresponding to the temporary inactive mode, the via is misaligned with a portion of the top and the bottom conductive contacts and current is prohibited from flowing between the top and the bottom conductive contacts through the via due to the misalignment, defining a temporary open switch position.

11. The method of claim 10, further comprising providing an embedded energy storage device including a lithium ion battery.

12. The method of claim 10, wherein when the pull tab is in the first position corresponding to the temporary active mode in the adjusting step, further including: aligning the via with a portion of the top and the bottom conductive contacts; and allowing current to flow between the top and the bottom conductive contacts through the via, defining a temporary closed switch position.

13. The method of claim 10, wherein when the pull tab is in the first position corresponding to the temporary active mode in the adjusting step, further including: allowing current to flow between the top and the bottom conductive contacts through the via, defining a temporary closed switch position; and testing the portable device relative to at least one of acoustics, audio quality of internal speakers, calibration of multiple internal microphones, confirmation of proper multi-function button operation, volume operation, power switch operation, and noise cancellation algorithm operation.

14. The method of claim 10, wherein when the pull tab is in the second position corresponding to the temporary inactive mode in the adjusting step, further including: misaligning the via with a portion of the top and the bottom conductive contacts; and prohibiting current to flow between the top and the bottom conductive contacts through the via due to the misalignment, defining a temporary open switch position.

15. The method of claim 10, wherein the constructing step includes: providing the pull tab with at least two vias configured to allow at least two temporary active modes; aligning at least one of the vias with a portion of the top and the bottom conductive contacts; and allowing current to flow between the top and the bottom conductive contacts through the aligned at least one via, defining a temporary closed switch position.

16. The method of claim 10, wherein the providing step includes: providing an energy storage device including a lithium ion battery; and configuring the portable device in wireless communication with the wireless communication device via a personal area network.

* * * * *